US007390541B2

(12) United States Patent
Hsu

(10) Patent No.: US 7,390,541 B2
(45) **Date of Patent: *Jun. 24, 2008**

(54) ROTATING INFLATABLE ORNAMENT

(76) Inventor: Sheng-Hung Hsu, No. 6, Yonghong Lane, Hou-An Village, Renwu Hsiang, Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/230,501

(22) Filed: Sep. 21, 2005

(65) Prior Publication Data

US 2007/0065605 A1 Mar. 22, 2007

(51) Int. Cl.
*A63H 3/06* (2006.01)

(52) U.S. Cl. ..... 428/9; 428/12; 472/134; 446/220; 446/221; 446/223

(58) Field of Classification Search ..... 428/8, 428/9, 12; 5/713, 708; 40/412, 414; 472/134; 446/220–226

See application file for complete search history.

(56) References Cited

U.S. PATENT DOCUMENTS 7,108,608 B2 * 9/2006 Field et al. ..... 472/134
2005/0106990 A1 * 5/2005 Field et al. ..... 446/220

* cited by examiner

*Primary Examiner*—John J. Zimmerman
*Assistant Examiner*—Aaron Austin

(57) ABSTRACT

A rotating inflatable ornament has a main chamber, a bottom chamber, a blower, a rotating chamber, a rotating device and a joint tube. The bottom chamber is attached to the main chamber. The blower is mounted in the bottom chamber and fills the bottom chamber with air. The rotating chamber is mounted in the main chamber and has a main air tube and multiple inflatable adornments. The main air tube communicates with the bottom chamber. The rotating device is attached rotatably to the main chamber. The joint tube has an outer tube, an inner tube and a motor. The outer tube is attached to the bottom chamber. The inner tube is mounted rotatably in the outer tube and is attached to the main air tube. The motor rotates the rotating chamber to give a lively impression.

8 Claims, 7 Drawing Sheets

ROTATING INFLATABLE ORNAMENT

BACKGROUND OF THE INVENTION

1. Field of the Invention

The present invention relates to an inflatable ornament, especially to a rotating inflatable ornament.

2. Description of the Prior Arts

Very large ornaments are often used in department stores, shopping malls and expositions to advertise or attract a crowd. To be stowed easily, the ornaments are often inflatable. When the inflatable ornaments are exhibited, the inflatable ornaments are inflated. When the inflatable ornaments are stowed, the inflatable ornaments are deflated. However, conventional inflatable ornaments are static. Therefore, the conventional inflatable ornaments do not give lively impressions.

To overcome the shortcomings, the present invention provides a rotating inflatable ornament to mitigate or obviate the aforementioned problems.

SUMMARY OF THE INVENTION

The main objective of the present invention is to provide a rotating inflatable ornament to give a lively impression. The rotating inflatable ornament in accordance with the present invention has a main chamber, a bottom chamber, a blower, a rotating chamber, a rotating device and a joint tube. The bottom chamber is attached to the main chamber. The blower is mounted in the bottom chamber and fills the bottom chamber with air. The rotating chamber is mounted in the main chamber and has a main air tube and multiple inflatable adornments. The main air tube communicates with the bottom chamber. The rotating device is attached rotatably to the main chamber. The joint tube has an outer tube, an inner tube and a motor. The outer tube is attached to the bottom chamber. The inner tube is mounted rotatably in the outer tube and is attached to the main air tube. The motor rotates the rotating chamber to give a lively impression.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
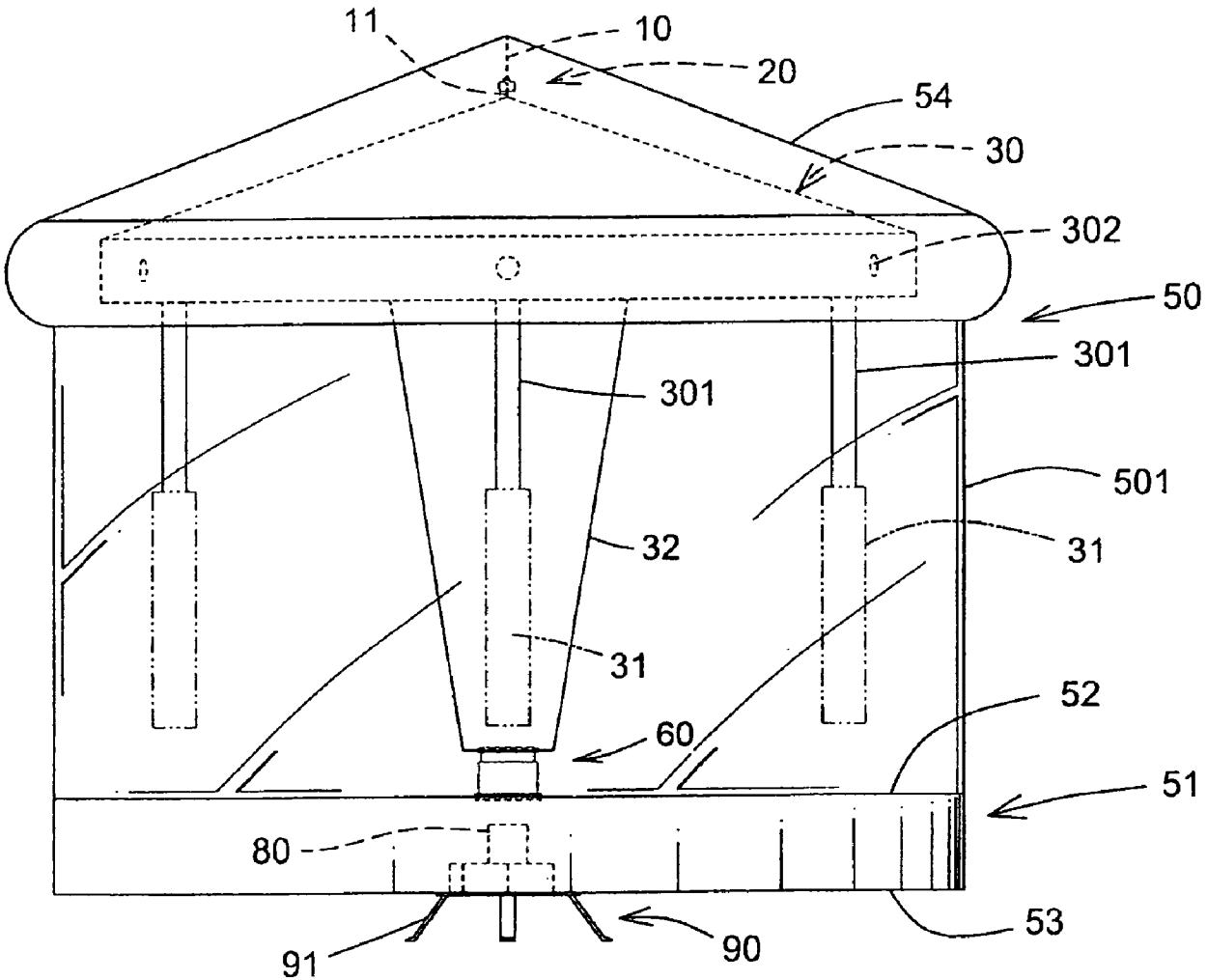
FIG. 1 is a side view of a rotating inflatable ornament in accordance with the present invention.

With reference to FIGS. 1, 2, 7 and 8, a rotating inflatable ornament in accordance with the present invention comprises a main chamber (50, 50'), a bottom chamber (51), a base (90), a blower (80), a rotating device (20), a joint tube (60) and a rotating chamber (30).

Figure 2:
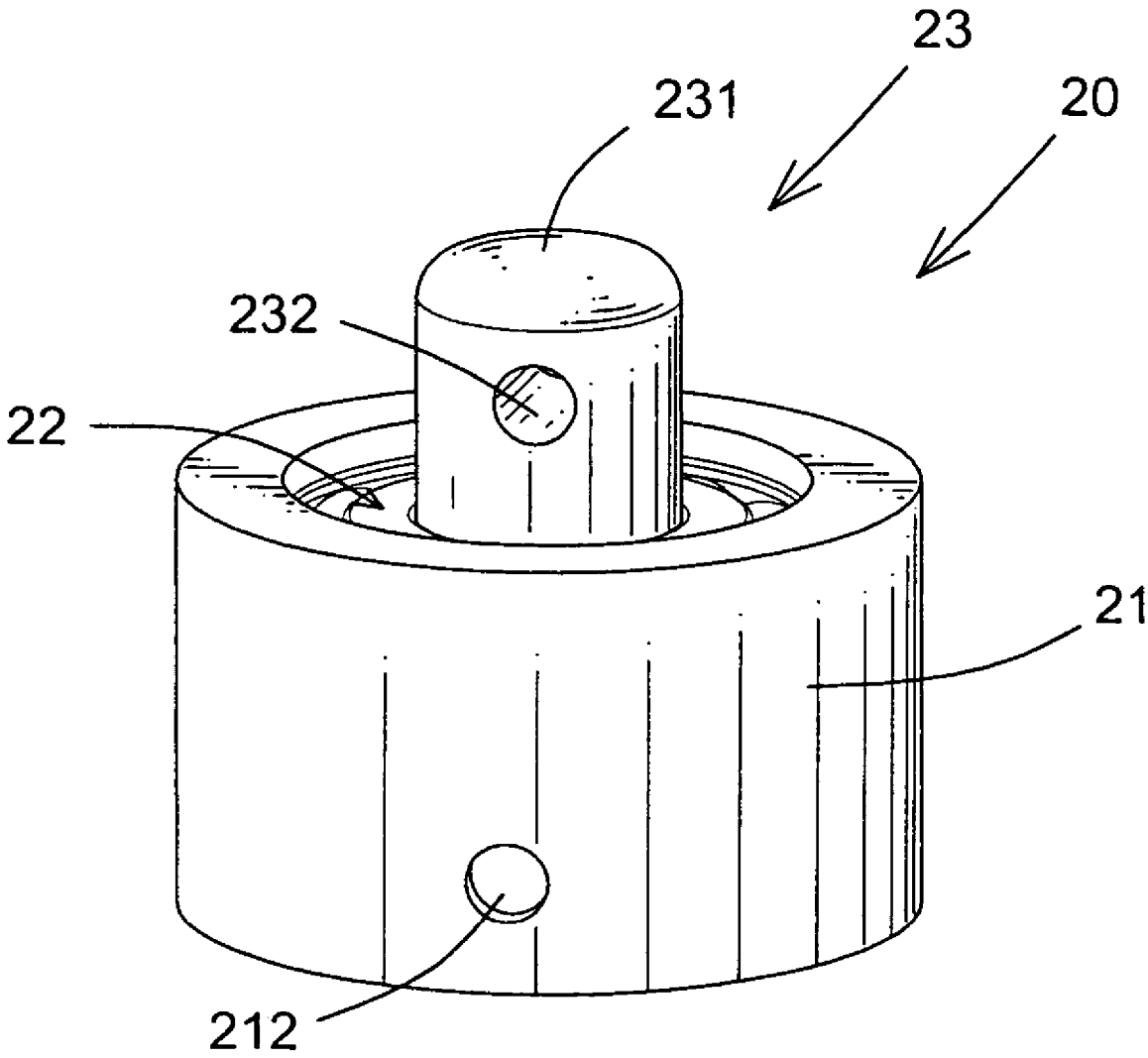
FIG. 2 is an enlarged perspective view of a rotating device in the rotating inflatable ornament in FIG. 1.

With reference to FIGS. 1 and 2, the main chamber (50) is hollow and transparent and has a top, a bottom, an inside surface and a stationary cord (10) and may have a body (501) and a top chamber (54). The body (501) of the main chamber (50) has a top and a bottom. The top chamber (54) is attached to the top of the body (501) of the main chamber (50), communicates with the body (501) of the main chamber (50) and has an inside surface. The stationary cord (10) may be attached to the inside surface of the top chamber (54).

The bottom chamber (51) is hollow and is attached to the bottom of the body (501) of the main chamber (50). The bottom chamber (51) communicates with the body (501) of the main chamber (50). The bottom chamber (51) has a top (52) and a bottom (53). The top (52) is attached to and corresponds to the bottom of the body (501) of the main chamber (50).

The base (90) is attached to the bottom (53) of the bottom chamber (51) and has multiple supports (91) to stand on the ground.

The blower (80) is mounted in the bottom chamber (51) to fill the bottom chamber (51) with air and corresponds to the base (90).

The top chamber (54) is attached to the top of the main chamber (50), communicates with the main chamber (50) and has an inside surface. The stationary cord (10) is attached to the inside surface of the top chamber (54).

Figure 3:
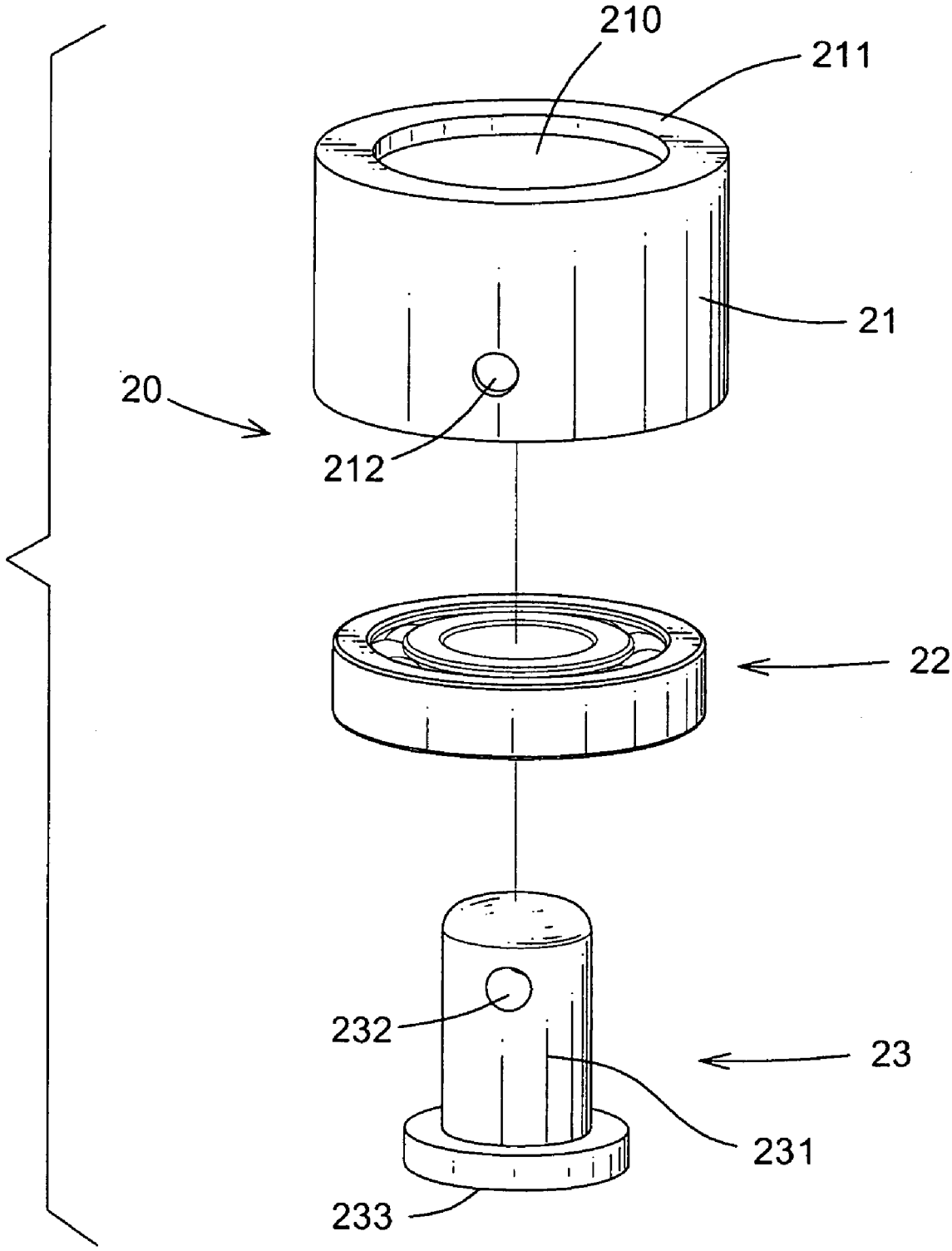
FIG. 3 is an exploded perspective view of the rotating device in FIG. 2.
Figure 4:
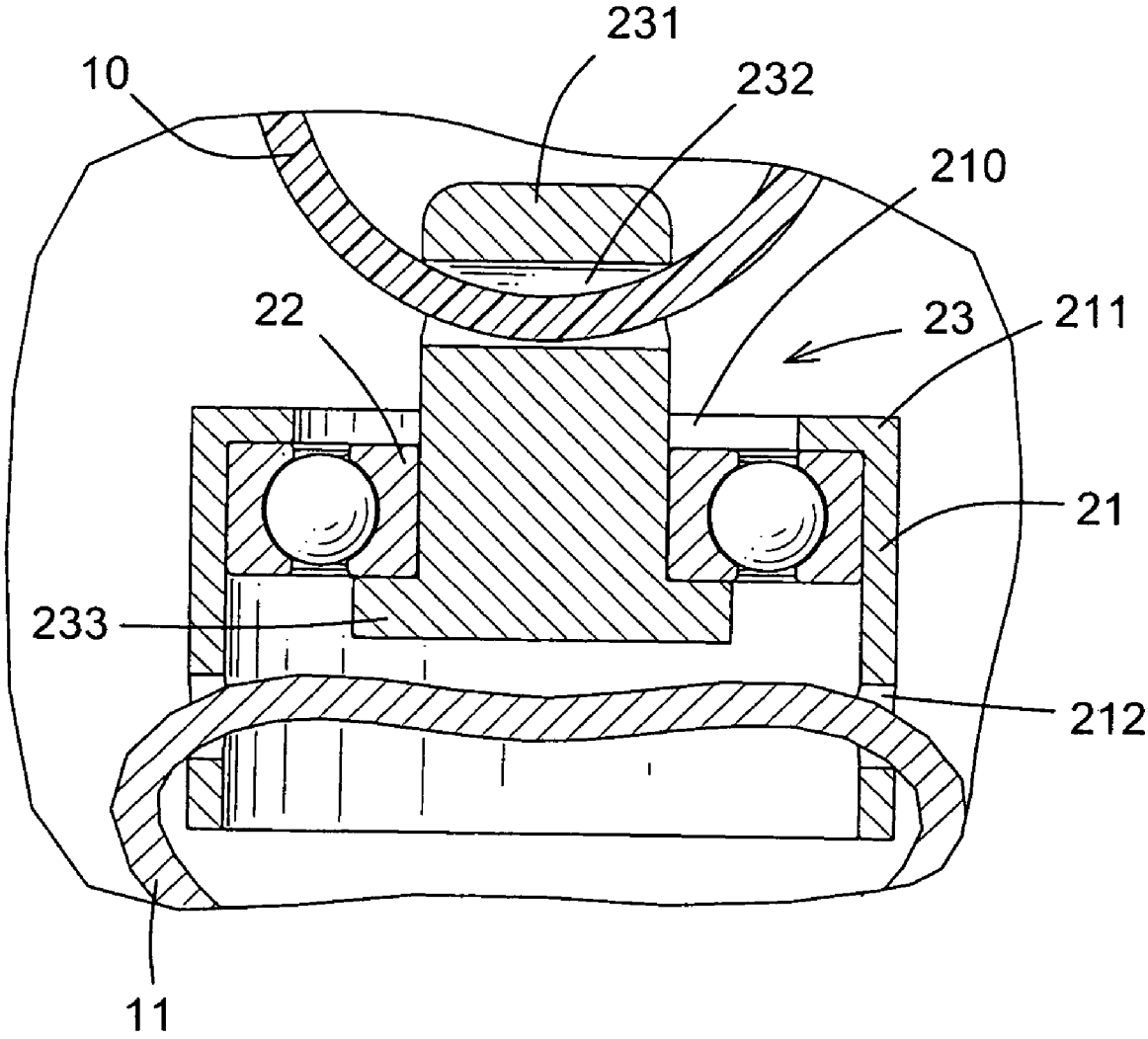
FIG. 4 is an enlarged cross sectional side view of the rotating device mounted in the rotating inflatable ornament in FIG. 1.

With further reference to FIGS. 3 and 4, the rotating device (20) is attached to the stationary cord (10), is rotatable and may have a sleeve (21), a bearing (22), a shaft (23) and a rotating cord (11).

The sleeve (21) is hollow and has a top opening (210), a sidewall, an annular flange (211) and a pair of through holes (212). The sidewall has a top and a bottom. The annular flange (211) is formed on and protrudes in from the top of the sidewall of the sleeve (21). The pair of through holes (212) are formed opposite to each other through the sidewall of the sleeve (21) near the bottom.

The bearing (22) is mounted in the sleeve (21) against the annular flange (211).

The shaft (23) is mounted in the bearing (22), protrudes out from the top opening (210) of the sleeve (21) and has a rod (231), a through hole (232) and an annular flange (233). The rod (231) has an upper end and a lower end. The through hole (232) is formed through the rod (231) near the upper end and holds the stationary cord (10). The annular flange (233) is formed on and extends radially out from the lower end of the rod (231).

The rotating cord (11) passes through the pair of through holes (212) in the sleeve (21).

Figure 5:
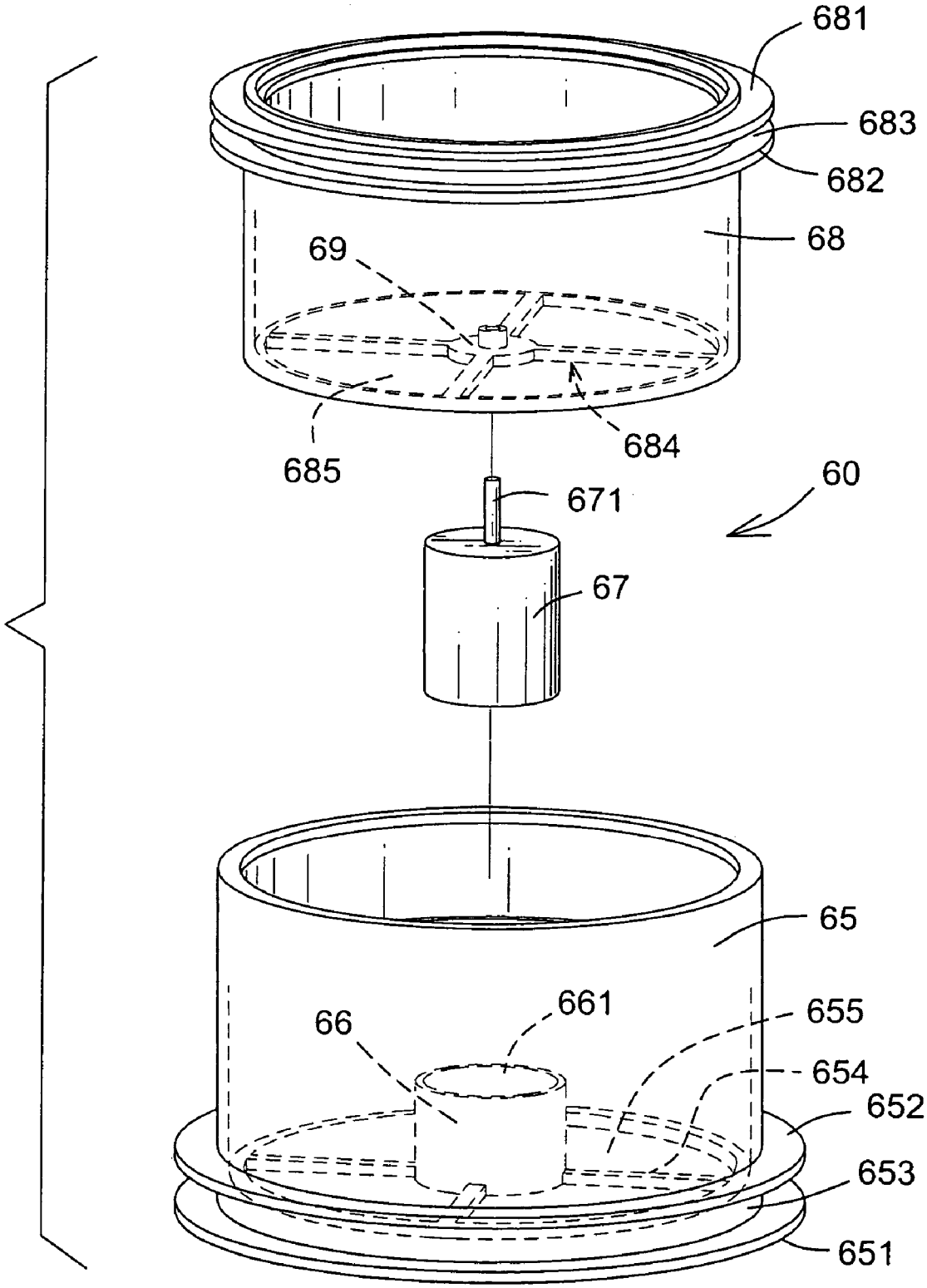
FIG. 5 is an exploded perspective view of a joint tube of the rotating inflatable ornament in FIG. 1.
Figure 6:
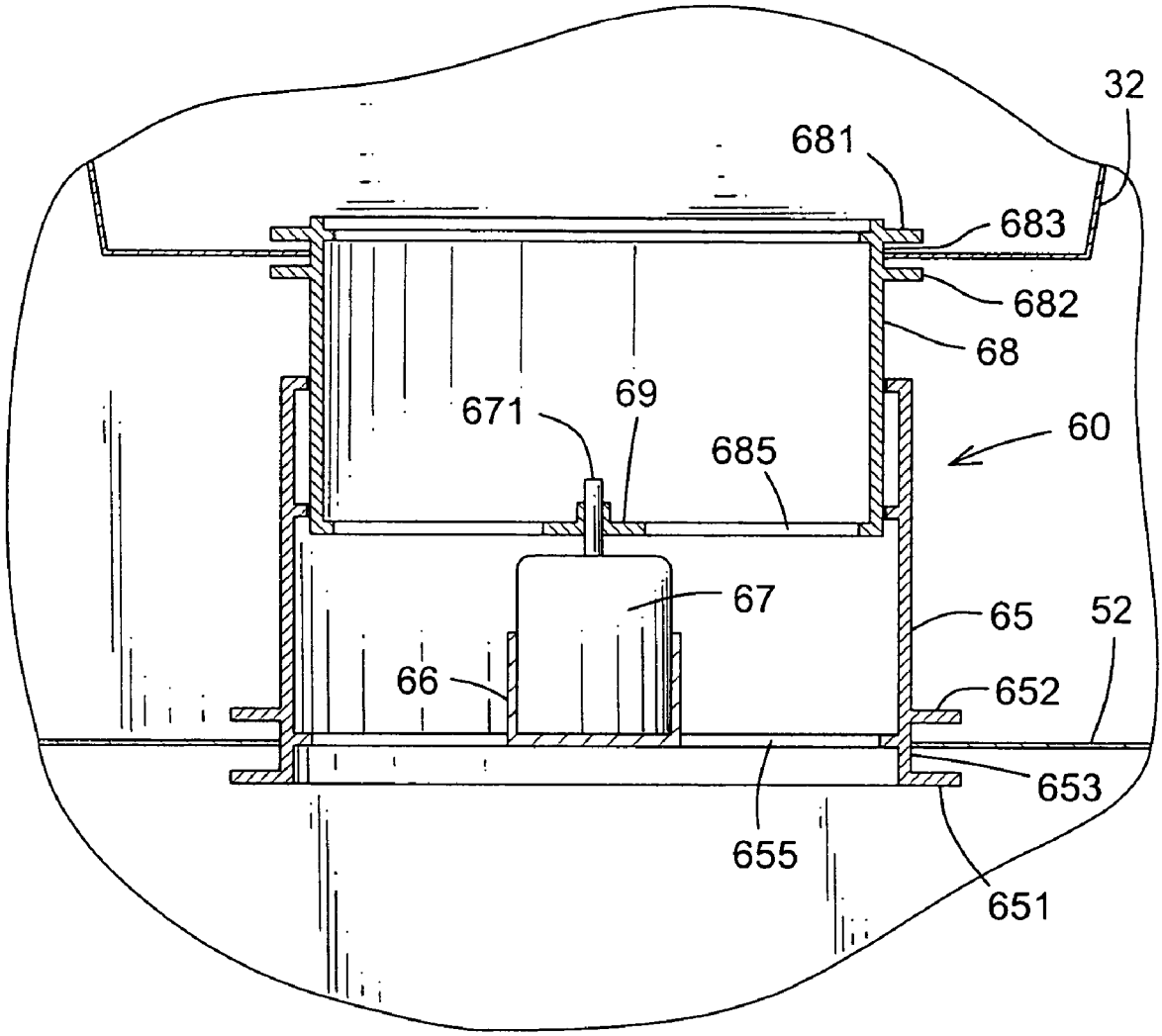
FIG. 6 is an enlarged cross sectional side view of the joint tube in the rotating inflatable ornament in FIG. 1.

With further reference to FIGS. 5 and 6, the joint tube (60) is attached to the bottom chamber (51), is rotatable and has an outer tube (65), an inner tube (68), a motor (67) and a rod (671).

The outer tube (65) is attached to the top (52) of the bottom chamber (51), communicates with the bottom chamber (51) and may have a distal end, a proximal end, an outside wall, an inside wall, a lower flange (651), an upper flange (652), an annular gap (653), multiple ribs (654), multiple apertures (655) and a sleeve (66). The distal end of the outer tube (65) extends into the top (52) of the bottom chamber (5 1). The lower flange (651) is formed around the distal end of the outer tube (65) and protrudes radially out from the outside wall of the outer tube (65). The upper flange (652) is formed around and protrudes radially out of the outside wall of the outer tube (65) near the lower flange (651). The annular gap (653) is formed between the lower and upper flanges (651, 652) on the outer tube (65). The ribs (654) are formed on and protrude radially in from the inside wall of the outer tube (65). The apertures (655) are formed between the ribs (654). The sleeve (66) is attached to the ribs (654).

The inner tube (68) is mounted rotatably in and communicates with the outer tube (65) and may have an outside wall, an inside wall, a proximal end, a distal end, an upper flange (681), a lower flange (682), an annular gap (683), multiple ribs (684), multiple apertures (685) and a bracket (69). The proximal end of the inner tube (68) is mounted rotatably in the proximal end of the outer tube (65). The upper flange (681) is formed around the distal end of the inner tube (68) and protrudes out radially from the outside wall of the inner tube (68). The lower flange (682) is formed around and protrudes out radially from the outside wall of the inner tube (68) near the upper flange (681) on the inner tube (68). The annular gap (683) is formed between the upper and lower flanges (681, 682) on the inner tube (68). The ribs (684) are formed on and protrudes radially in from the inside wall of the inner tube (68). The apertures (685) are formed between the ribs (684) in the inner tube (68). The bracket (69) is attached to the ribs (684) in the inner tube (68) and corresponds to the sleeve (66) in the outer tube (65).

The motor (67) is attached to the outer tube (65) and may be mounted securely in the sleeve (66) in the outer tube (65).

The rod (671) is mounted in and rotated by the motor (67), is attached to the inner tube (68) and may be mounted securely in the bracket (69) in the inner tube (68).

The rotating chamber (30) is mounted in the top chamber (54) and extends into the body of the main chamber (50). The rotating chamber (30) has a body, at least one nozzle (302), a main air tube (32), multiple inflatable adornments (31) and multiple optional secondary air tubes (301). The body of the rotating chamber (30) is attached to the rotating device (20), is attached to the rotating cord (11) and has a bottom and a sidewall. The at least one nozzle (302) is formed in the sidewall of the body of the rotating chamber (30) and communicates the body of the rotating chamber (30) with the top chamber (54). The main air tube (32) is formed in the bottom of the body of the rotating chamber (30), communicates with the inner tube (68) of the joint tube (60) and the body of the rotating chamber (30), extends into the body (501) of the main chamber (50) and has a distal end. The distal end of the main air tube (32) is attached to the joint tube (60) and is mounted securely in the annular gap (683) in the inner tube (68) of the joint tube (60). The inflatable adornments (31) are mounted on the bottom of the body of the rotating chamber (30) and communicates with the body of the rotating chamber (30). The secondary air tubes (301) are mounted respectively between the inflatable adornments (31) and the bottom of the body of the rotating chamber (30) and communicate between the inflatable adornments (31) and the body of the rotating chamber (30).

With reference to FIG. 1, the blower (80) pumps air into the main air tube (32) through the joint tube (60). The body of the rotating chamber (30) is filled with air. The air is injected into the top chamber (54) through the at least one nozzle (302) and fills the top chamber (54) and the main chamber (10). With further reference to FIG. 6, the motor (67) rotates the rod (671), and the rod (671) rotates the inner tube (68). Because the inner tube (68) is attached to the main air tube (32) of the rotating chamber (30), the rotating chamber (30) is rotated. With further reference to FIG. 4, the sleeve (21) rotates around the shaft (23). Then the inflatable adornments (31) are rotated with the rotating chamber (30) to give a lively impression.

Figure 7:
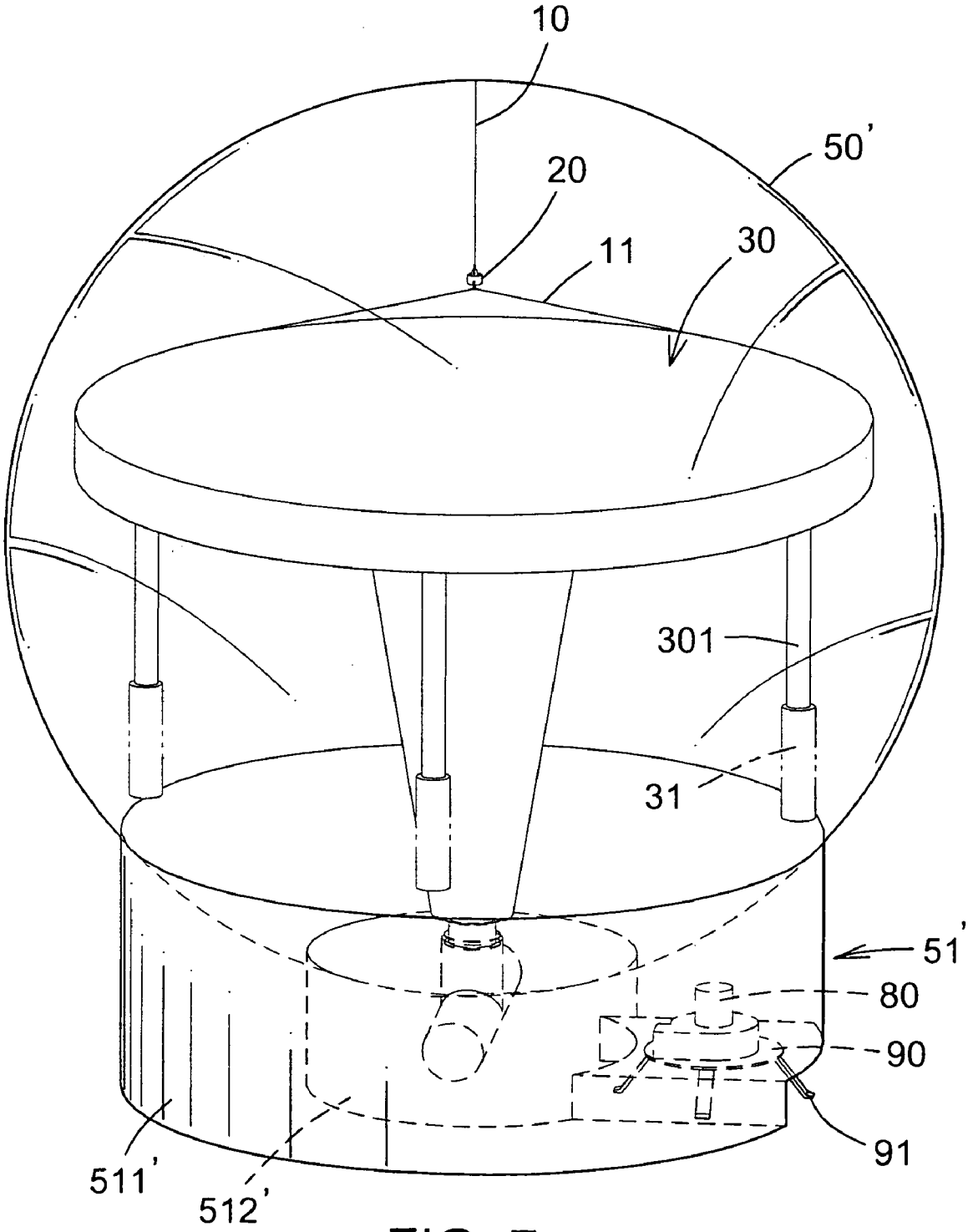
FIG. 7 is a side view of another embodiment of a rotating inflatable ornament in accordance with the present invention.

The second embodiment in accordance with the present invention is shown in FIGS. 7 and 8. The main chamber (50') is spherical. The stationary cord (10) is attached to the inside surface of the main chamber (50'). The bottom chamber (51') is hollow, is attached to the bottom of the main chamber (50'), communicates with the main chamber (50') and may have an outer chamber (511') and an inner chamber (512'). The top (52') of the bottom chamber (51') is attached to and corresponds to the bottom of the main chamber (50'). The inner chamber (512') of the bottom chamber (51') communicates with the outer chamber (511') of the bottom chamber (51'). The blower (80) is mounted in the outer chamber (511') of the bottom chamber (51'). The rotating chamber (30) is mounted rotatably in the main chamber (50'). The at least one nozzle (302) communicates the body of the rotating chamber (30) with the main chamber (50')

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An rotating inflatable ornament comprising:

a main chamber being hollow and transparent and having
- a top;
- a bottom;
- an inside surface; and
- a stationary cord attached to the inside of the main chamber;

a bottom chamber being hollow, attached to the bottom of the main chamber, communicating with the main chamber and having
- a top attached to and corresponding to the bottom of the main chamber; and
- a bottom;

a base attached to the bottom of the bottom chamber and having multiple supports;

a blower mounted in the bottom chamber and corresponding to the base;

a rotating device attached to the stationary cord and being rotatable;

a joint tube attached to the bottom chamber being rotatable and having
- an outer tube attached to the top of the bottom chamber and communicating with the bottom chamber;
- an inner tube mounted rotatably in and communicating with the outer tube;
- a motor attached to the outer tube; and
- a rod mounted in and rotated by the motor and attached to the inner tube; and a rotating chamber mounted rotatably in the main chamber and having
- a body attached to the rotating device and having a bottom and a sidewall;
- at least one nozzle formed in the sidewall of the body of the rotating chamber to communicate between the body of the rotating chamber and the main chamber;
- a main air-entering tube formed in the bottom of the body of the rotating chamber, communicating with the inner tube of the joint tube and the body of the rotating chamber and having a distal end attached to the joint tube; and multiple inflatable adornments mounted on the bottom of the body of the rotating chamber and communicating with the body of the rotating chamber.

2. The rotating inflatable ornament as claimed in claim 1, wherein the main chamber is spherical;

the bottom chamber has an outer chamber; and an inner chamber communicating with the outer chamber of the bottom chamber; and the blower is mounted in the outer chamber of the bottom chamber.

3. The rotating inflatable ornament as claimed in claim 1, wherein the main chamber has a body having a top and a bottom; and a top chamber attached to the top of the body of the main chamber, communicating with the body of the main chamber and having an inside surface;

the stationary cord is attached to the inside surface of the top chamber;

the bottom chamber is attached to the bottom of the body of the main chamber and communicates with the body of the main chamber;

the top of the bottom chamber is attached to and corresponds to the bottom of the body of the main chamber;

the rotating chamber is mounted in the top chamber and extends into the body of the main chamber;

the at least one nozzle of the rotating chamber is to communicate between the body of the rotating chamber and the top chamber; and the main air-entering tube extends into the body of the main chamber.

4. The rotating inflatable ornament as claimed in claim 3, wherein the outer tube of the joint tube has a distal end extending into the top of the bottom chamber;

a proximal end;

an outside wall;

an inside wall;

a lower flange formed around the distal end of the outer tube and protruding radially out from the outside wall of the outer tube;

an upper flange formed around and protruding radially out from the outside wall of the outer tube near the lower flange;

an annular gap formed between the lower and upper flanges on the outer tube;

multiple ribs formed on and protruding radially in from the inside wall of the outer tube;

multiple apertures formed between the ribs; and a sleeve attached to the ribs;

the inner tube of the joint tube has an outside wall;

an inside wall;

a proximal end mounted rotatably in the proximal end of the outer tube a distal end;

an upper flange formed around the distal end of the inner tube and protruding out radially from the outside wall of the inner tube;

a lower flange formed around and protruding out radially from the outside wall of the inner tube near the upper flange on the inner tube;

an annular gap formed between the upper and lower flanges on the inner tube;

multiple ribs formed on and protruding radially in from the inside wall of the inner tube;

multiple apertures formed between the ribs in the inner tube; and a bracket attached to the ribs in the inner tube and corresponding to the sleeve in the outer tube;

the motor is mounted securely in the sleeve in the outer tube;

the rod is mounted securely in the bracket in the inner tube; and the distal end of the main air-entering tube mounted securely in the annular gap in the inner tube of the joint tube.

5. The rotatable and inflatable ornament as claimed in claim 3, wherein the rotating chamber has multiple secondary air tubes mounted respectively between the inflatable adornments and the bottom of the body of the rotating chamber and communicating between the inflatable adornments and the body of the rotating chamber.

6. The rotating inflatable ornament as claimed in claim 3, wherein the rotating device has a sleeve being hollow and having a top opening;

a sidewall having a top and a bottom;

an annular flange formed on and protruding in from the top of the sidewall of the sleeve; and a pair of through holes formed opposite to each other through the sidewall of the sleeve near the bottom;

a bearing mounted in the sleeve against the annular flange;

a shaft mounted in the bearing, protruding out from the top opening of the sleeve and having a rod having an upper end and a lower end;

a through hole formed through the rod near the upper end and holding the stationary cord; and an annular flange formed on and extending out radially from the lower end of the rod; and a rotating cord passing through the pair of through holes in the sleeve and attached to the body of the rotating chamber.

7. The rotating inflatable ornament as claimed in claim 6, wherein the outer tube of the joint tube has a distal end extending into the top of the bottom chamber;

a proximal end;

an outside wall;

an inside wall;

a lower flange formed around the distal end of the outer tube and protruding radially out from the outside wall of the outer tube;

an upper flange formed around and protruding radially out from the outside wall of the outer tube near the lower flange;

an annular gap formed between the lower and upper flanges on the outer tube;

multiple ribs formed on and protruding radially in from the inside wall of the outer tube;

multiple apertures formed between the ribs; and a sleeve attached to the ribs;

the inner tube of the joint tube has an outside wall;

an inside wall;

a proximal end mounted rotatably in the proximal end of the outer tube;

a distal end;

an upper flange formed around the distal end of the inner tube and protruding out radially from the outside wall of the inner tube;

a lower flange formed around and protruding out radially from the outside wall of the inner tube near the upper flange on the inner tube;

an annular gap formed between the upper and lower flanges on the inner tube;

multiple ribs formed on and protruding radially in from the inside wall of the inner tube;

multiple apertures formed between the ribs in the inner tube; and a bracket attached to the ribs in the inner tube and corresponding to the sleeve in the outer tube;

the motor is mounted securely in the sleeve in the outer tube;

the rod is mounted securely in the bracket in the inner tube; and the distal end of the main air tube mounted securely in the annular gap of the inner tube of the joint tube.

8. The rotatable and inflatable ornament as claimed in claim 7, wherein the rotating chamber has multiple secondary air tubes mounted respectively between the inflatable adornments and the bottom of the body of the rotating chamber and communicating between the inflatable adornments and the body of the rotating chamber.

* * * * *